US008042846B2

(12) United States Patent
Ruggerio

(10) Patent No.: US 8,042,846 B2
(45) Date of Patent: Oct. 25, 2011

(54) DOOR WEDGE APPARATUS

(75) Inventor: James L. Ruggerio, North Port, FL (US)

(73) Assignee: James L. Ruggerio, North Port, FL (US)

( * ) Notice: Subject to any disclaimer, the term of this patent is extended or adjusted under 35 U.S.C. 154(b) by 0 days.

(21) Appl. No.: 12/386,806

(22) Filed: Apr. 23, 2009

(65) Prior Publication Data

US 2011/0062729 A1 Mar. 17, 2011

Related U.S. Application Data

(60) Provisional application No. 61/125,384, filed on Apr. 25, 2008.

(51) Int. Cl.
*E05C 17/50* (2006.01)

(52) U.S. Cl. ..... 292/343; 292/342

(58) Field of Classification Search ..... 292/342, 292/343, 288, 289; 16/82
See application file for complete search history.

(56) References Cited

U.S. PATENT DOCUMENTS

| | | | | | |
|---|---|---|---|---|---|
| 110,985 | A * | 1/1871 | Lugrin | 292/343 |
| 398,889 | A * | 3/1889 | Gehrung | 292/334 |
| 971,717 | A * | 10/1910 | Bates | 292/343 |
| 1,633,202 | A * | 6/1927 | Williams | 292/343 |
| 1,667,771 | A * | 5/1928 | Chiapparelli | 292/128 |
| 1,845,829 | A * | 2/1932 | Carnal | 292/343 |
| 2,461,398 | A * | 2/1949 | Sands | 292/297 |
| 3,143,369 | A | 8/1964 | Adams | |
| 3,328,065 | A * | 6/1967 | Arenson | 292/343 |
| 4,142,752 | A * | 3/1979 | Chilton | 292/343 |
| 4,341,042 | A * | 7/1982 | Schulz | 49/404 |
| 4,501,444 | A | 2/1985 | Dominguez | |
| 4,552,395 | A * | 11/1985 | Dominguez | 292/342 |
| 4,631,776 | A * | 12/1986 | King | 16/82 |
| 4,660,323 | A * | 4/1987 | Kanies | 49/70 |
| 4,805,948 | A * | 2/1989 | Renzi | 292/342 |
| 5,008,648 | A | 4/1991 | Conemac | |
| 5,447,347 | A * | 9/1995 | Siddons | 292/342 |
| 5,465,460 | A * | 11/1995 | Cantone | 16/82 |
| 5,755,582 | A * | 5/1998 | Charlton | 439/131 |
| 5,809,613 | A * | 9/1998 | Baines | 16/82 |

* cited by examiner

*Primary Examiner* — Kristina Fulton

(57) ABSTRACT

A wedge apparatus includes a first wedge member and a second wedge member. A pivot pin is interconnected between a front end of the first wedge member and a front end of the second wedge member. A compressible spring is interconnected between the first wedge member and the second wedge member at a location distal from the pivot pin. The first wedge member can be substantially U-shaped and can include upwardly oriented first flange portions. Similarly, the second wedge member can be substantially U-shaped and can include downwardly oriented second flange portions. The U-shaped second wedge member is nested within the U-shaped first wedge member when the compressible spring is fully compressed between the first wedge member and the second wedge member. Preferably, a quantity of high friction material is bonded to the first wedge member bottom surface, and a second quantity of high friction material is bonded to the second wedge member top surface.

2 Claims, 3 Drawing Sheets

FIG 1
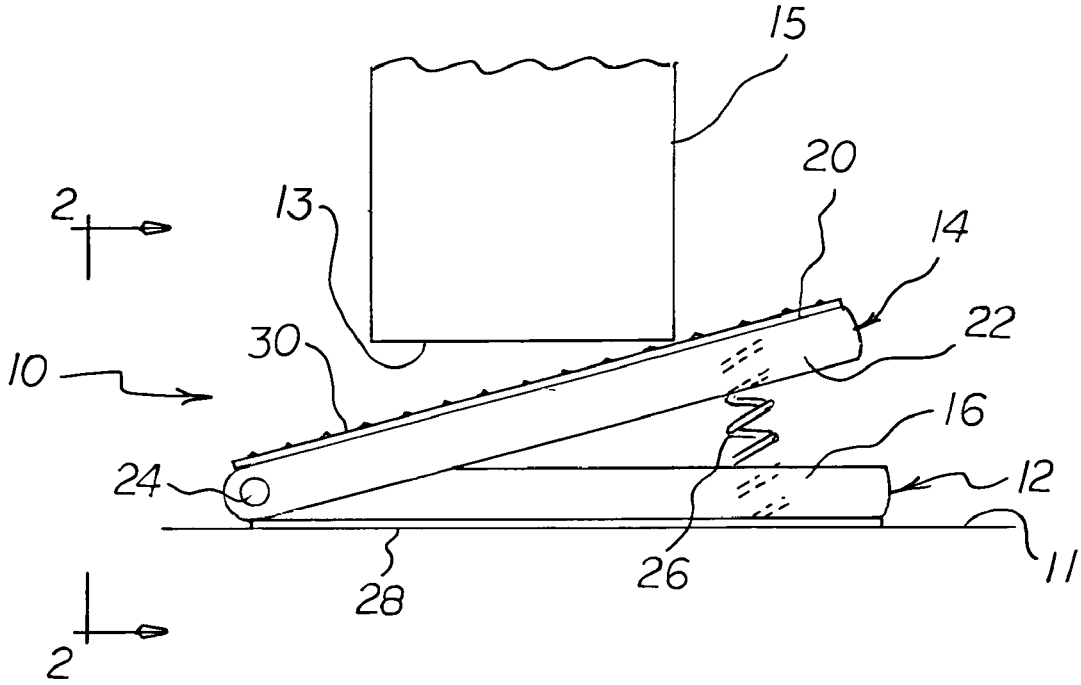
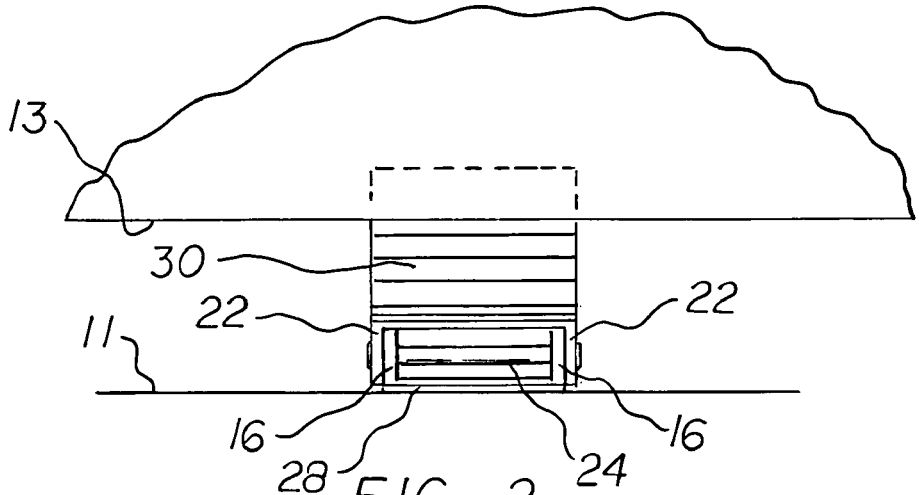
FIG 2

FIG 3
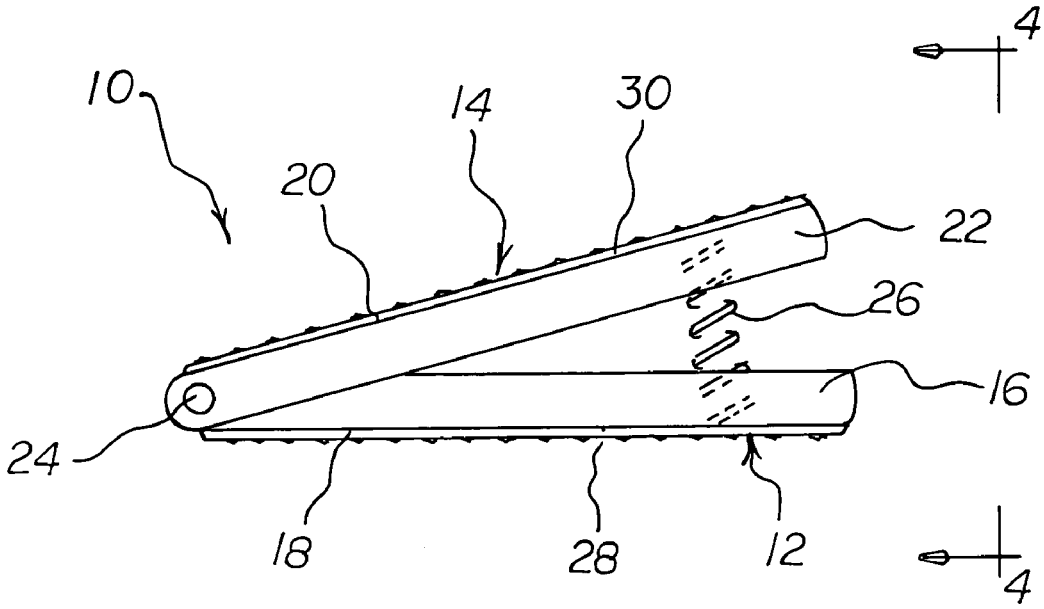
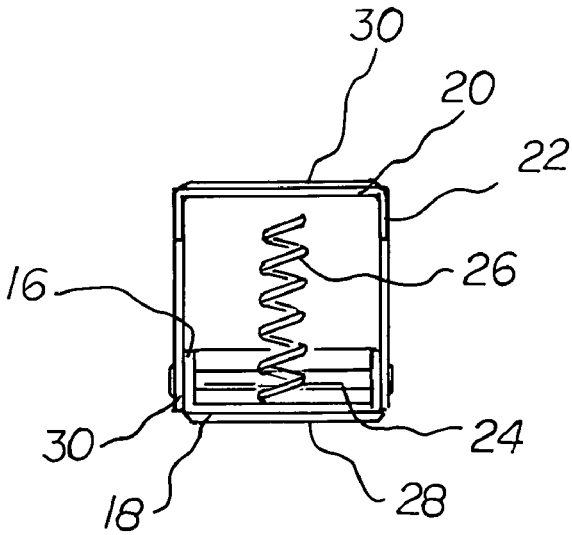
FIG 4

FIG 5
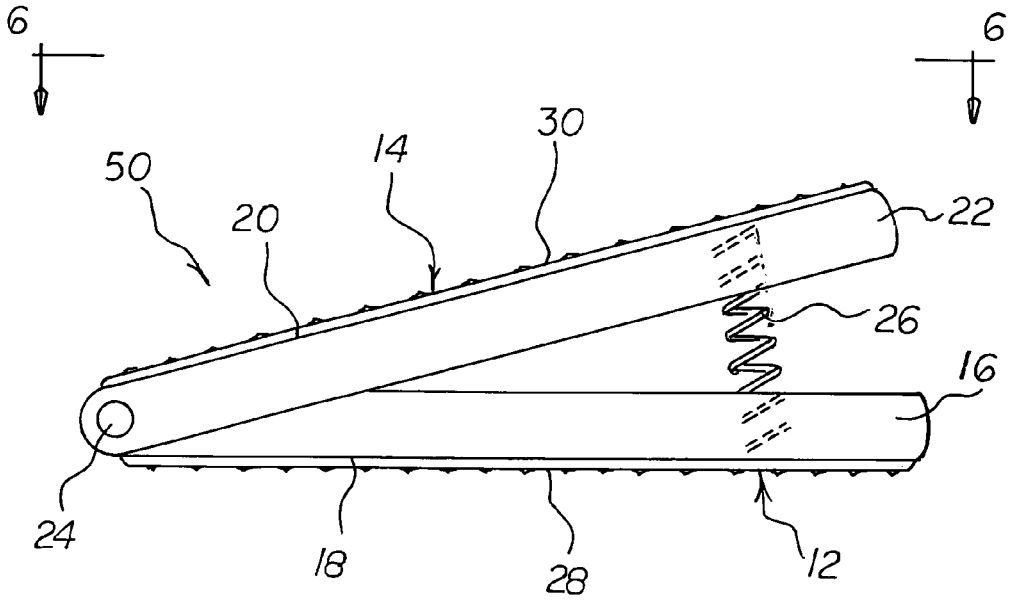
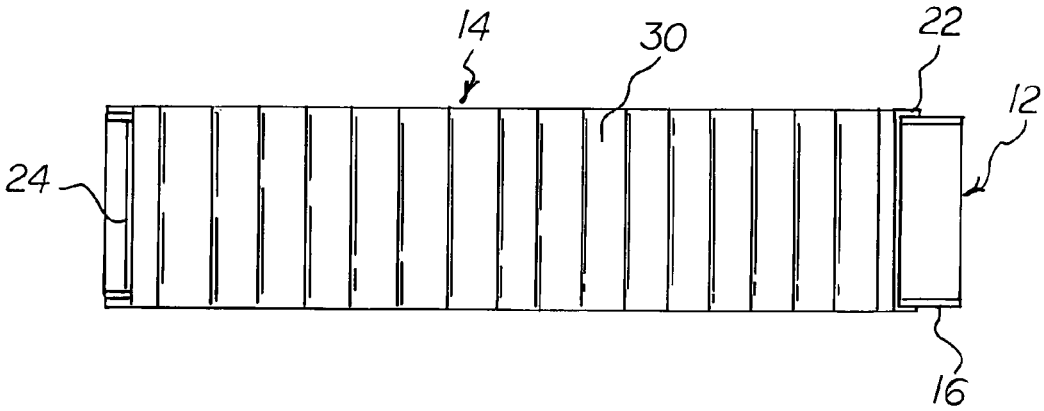
FIG 6

DOOR WEDGE APPARATUS

CROSS-REFERENCE TO RELATED APPLICATION

This application claims priority based upon my Provisional Application Ser. No. 61/125,384; filed Apr. 25, 2008.

BACKGROUND OF THE INVENTION

1. Field of the Invention

The present invention relates generally to door wedges used between a door and a floor, and, more particularly, to door wedges which include a spring for exerting a force between a door and a floor.

2. Description of the Prior Art

The use of door wedges is well known for placement between a door and a floor, primarily to keep the door open and preventing the door to close while the wedge is in use.

Throughout the years, a number of innovations have been developed relating to using spring action in conjunction with a door wedge, and the following U.S. patents are representative of some of those innovations: U.S. Pat. Nos. 4,142,752, 4,501,444, 5,008,648, and 5,447,347.

More specifically, U.S. Pat. No. 4,142,752 discloses a burglar entry stop device which employs a wedge. A spring-biased steel pin is contiguous with the underside with an upper steel plate. The spring does not extend between and upper plate and a lower plate. Therefore, the spring does not exert a direct upward force on the bottom of the door on which the wedge is employed. In this respect, for purposes of efficiency and efficacy, it would be desirable if a door wedge were provided which employs a spring which applies a direct upward force on the bottom of a door on which the wedge is employed.

U.S. Pat. No. 4,501,444 discloses a door wedge which has a spring-containing latching mechanism. The latching mechanism serves to keep the wedge compressed when the wedge is not in use. More specifically, the spring-containing latch mechanism is parallel to the top surface and serves to lock the top member to the bottom member when the wedge is not in use. Clearly, the spring does not provide an upward force on the bottom of a door on which the wedge is employed. Moreover, the spring disclosed in this device is interconnected between both the upper and lower wedge members. In this respect, for purposes of efficiency and efficacy, it would be desirable if a door wedge were provided which employs a spring that is interconnected between both the upper and lower wedge members.

U.S. Pat. No. 5,008,648 discloses an electronic door wedge alarm in which a spring is placed between a slide bracket and the bottom chassis. The spring is adjacent to side-mounted pivot members. Clearly, the spring does not exert an upward force on a door, and the spring is not interconnected between both upper and lower wedge members.

U.S. Pat. No. 5,447,347 discloses an auxiliary door stop. A spring-loaded wedge member is provided that is located at the top of a bottom base. The top spring-loaded wedge member has an upper wedge member surface and a lower surface wedge member surface which are spaced apart from each other at approximately 45 degrees. The spring is interconnected between the bottom base and the lower surface wedge member surface. More specifically, the spring is not interconnected between the bottom base and the upper wedge member surface which actually contacts the door. However, for purposes of simplicity and efficacy, it would be desirable if a wedge apparatus were provided which employs a spring that is interconnected between an upper door-contacting wedge member and a lower floor-contacting wedge member without any intervening wedge members that do not contact either a door or a floor.

As a matter of interest, U.S. Pat. No. 3,143,369 discloses a door stop which has a circular top portion that is wedged between a door and floor. A spring is not provided with this door wedge.

Other features would also be desirable in a door wedge apparatus. For example, it would be desirable if a door wedge apparatus included a quantity of high friction material bonded to a top surface of a door-contacting wedge member.

It would also be desirable if a door wedge apparatus included a quantity of high friction material bonded to a bottom surface of a floor-contacting wedge member.

Thus, while the foregoing body of prior art indicates it to be well known to use a door wedge apparatus, the prior art described above does not teach or suggest a door wedge apparatus which has the following combination of desirable features: (1) employs a spring which applies a direct upward force on the bottom of a door on which the wedge is used; (2) employs a spring that is interconnected between both the upper and lower wedge members; (3) employs a spring that is interconnected between an upper door-contacting wedge member and a lower floor-contacting wedge member without any intervening wedge members that do not contact either a door or a floor; (4) includes a quantity of high friction material bonded to a top surface of a door-contacting wedge member; and (5) includes a quantity of high friction material bonded to a bottom surface of a floor-contacting wedge member.

The foregoing desired characteristics are provided by the unique door wedge apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a door wedge apparatus which includes a first wedge member which includes a first wedge member bottom surface. A second wedge member includes a second wedge member top surface. A pivot pin is interconnected between a front end of the first wedge member and a front end of the second wedge member. A compressible spring is interconnected between the first wedge member and the second wedge member at a location distal from the pivot pin.

The first wedge member can be substantially U-shaped and can include upwardly oriented first flange portions. Similarly, the second wedge member can be substantially U-shaped and can include downwardly oriented second flange portions. The pivot pin is received in pin-reception channels in the upwardly oriented first flange portions and the downwardly oriented second flange portions which are in registration with each other. The first wedge member and the second wedge member can be nested with respect to each other.

Preferably, the U-shaped second wedge member is nested within the U-shaped first wedge member when the compressible spring is fully compressed between the first wedge member and the second wedge member.

Preferably, a first quantity of high friction material is bonded to the first wedge member bottom surface, and a second quantity of high friction material is bonded to the second wedge member top surface.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining two preferred embodiment of the inventions in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door wedge apparatus which has all of the advantages of the prior art and none of the disadvantages.

It is another object of the present invention to provide a new and improved door wedge apparatus which may be easily and efficiently manufactured and marketed.

It is a further object of the present invention to provide a new and improved door wedge apparatus which is of durable and reliable construction.

An even further object of the present invention is to provide a new and improved door wedge apparatus which is susceptible of a low cost of manufacture with regard to both materials and labor, and which accordingly is then susceptible of low prices of sale to the consuming public, thereby making such door wedge apparatus available to the buying public.

Still yet a further object of the present invention is to provide a new and improved door wedge apparatus which employs a spring which applies a direct upward force on the bottom of a door on which the wedge is used.

Still another object of the present invention is to provide a new and improved door wedge apparatus that employs a spring that is interconnected between both the upper and lower wedge members.

Yet another object of the present invention is to provide a new and improved door wedge apparatus which employs a spring that is interconnected between an upper door-contacting wedge member and a lower floor-contacting wedge member without any intervening wedge members that do not contact either a door or a floor.

Even another object of the present invention is to provide a new and improved door wedge apparatus that includes a quantity of high friction material bonded to a top surface of a door-contacting wedge member.

Still a further object of the present invention is to provide a new and improved door wedge apparatus which includes a quantity of high friction material bonded to a bottom surface of a floor-contacting wedge member.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a first embodiment of the door wedge apparatus of the invention, such as for use in a residential home, wherein the door wedge apparatus is wedged against the bottom of a door to keep the door in an open status.

FIG. 2 is a front view of the embodiment of the door wedge apparatus shown in FIG. 1 taken along line 2-2 of FIG. 1.

FIG. 3 a side view showing the embodiment of the invention of FIG. 1, wherein the door wedge apparatus has been removed from contact with a door.

FIG. 4 is a rear view of the embodiment of the invention shown in FIG. 3 taken along line 4-4 thereof.

FIG. 5 is a side view showing a second embodiment of the door wedge apparatus of the invention, such as for use at a commercial job site, wherein the second embodiment of the invention has components which are larger and more heavy duty that the components shown in FIG. 1.

FIG. 6 is a top view of the embodiment of the invention shown in FIG. 5, taken along line 6-6 thereof.

DESCRIPTION OF THE PREFERRED EMBODIMENT

With reference to the drawings, a new and improved door wedge apparatus embodying the principles and concepts of the present invention will be described.

Turning to FIGS. 1-4, there is shown a first embodiment of the portable door wedge apparatus of the invention, adapted to be installed under residential or commercial doors without modification thereto, as is generally designated by reference numeral 10. In each of the figures, reference numerals are shown that correspond to like reference numerals that designate like elements shown in other figures.

In the first embodiment, door wedge apparatus 10 includes a first wedge member 12 which includes a first wedge member bottom surface 18. A second wedge member 14 includes a second wedge member top surface 20. A pivot pin 24 is interconnected between a front end of the first wedge member 12 and a front end of the second wedge member 14. A compressible spring 26 is interconnected between the first wedge member 12 and the second wedge member 14 at a location distal from the pivot pin 24. As shown in FIGS. 1 and 2, the wedge apparatus 10 of the invention can be used between a floor surface 11 and the bottom 13 of a door 15.

The first wedge member 12 can be substantially U-shaped in cross-section and can include upwardly oriented first flange portions 16. Similarly, the second wedge member 14 can be substantially U-shaped in cross-section and can include downwardly oriented second flange portions 22. Pivot pin and receiving holes 24 are shown as mutually aligned through the upwardly oriented first flange portions 16 and the downwardly oriented second flange portions 22 which are nested together.

The U-shaped second wedge member 14 is nested within the U-shaped first wedge member 12 when the compressible spring 26 is fully compressed between the first wedge member 12 and the second wedge member 14.

Preferably, a first quantity of high friction material 28 is bonded to the first wedge member bottom surface 18, and a second quantity of high friction material 30 is bonded to the second wedge member top surface 20. The first quantity of high friction material 28 and second quantity of high friction material 30 can be made from tread containing material which can be made from rubber materials and the like.

To use the first embodiment of the invention shown in FIGS. 1-4. A user grasps the wedge apparatus 10 and squeezes the first wedge member 12 toward the second wedge member 14, to overcome the resistance of the compressible spring 26 and compress the compressible spring 26, so that the wedge apparatus 10 can be inserted between the floor surface 11 and the bottom 13 of the door 15. Then, the user releases the wedge apparatus 10, and the freed compressible spring 26 urges the forces of opposite direction on the bottom 13 of the door 15 and the floor surface 11. The first quantity of high friction material 28 and the second quantity of high friction material 30 provide a good grip of the wedge apparatus 10 to both the door 15 and the second quantity of high friction material 30. In this way, the wedge apparatus 10 provides an effective, and easily installed wedge between the door 15 and the floor surface 11 to keep a wedged door 15 in an open condition.

To remove the installed wedge apparatus 10, the user can merely press down on the second wedge member 14 to overcome the resistance of the compressible spring 26 and remove the apparatus from between the door 15 and the floor surface 11.

Because the compressible spring 26 can be compressed throughout a wide range of distance, the wedge apparatus 10 is a one-size-fits-all wedge for a wide variety of doors and spacings between the bottom 13 of the door 15 and the floor surface 11.

It is noted that by changing the location of the compressible spring 26 with respect to its distal position from the pivot pin 24, the leverage of the first wedge member 12 and the second wedge member 14 in relation to the pivot pin 24, which serves as a fulcrum, will also change.

In FIGS. 5 and 6, a second embodiment 50 of the invention is shown. The second embodiment 50 of the invention and the first embodiment 10 of the invention are substantially the same with respect to the identity and the arrangement of their structural components, and they are used in substantially the same way. However, the first embodiment 10 of the invention and the second embodiment 50 of the invention are different in size and strength.

The first embodiment 10 of the invention is the smaller of the two and is intended to be used in a residential environment. In a residential environment, the distance between the bottom 13 of the door 15 and the floor surface 11 is relatively small. Moreover, the weight of the door 15 is relatively small. Therefore, the strength of the compressible spring 26 can be relatively small.

In contrast, the second embodiment 50 of the invention is made larger, with heavier and stronger components. This embodiment of the invention can be used in a commercial environment, such as a job site. At a job site, the distances between two objects in which the wedge apparatus 10 of the invention is employed can be relatively large. In addition, the respective weights of the objects that are wedged apart at a job site can be relatively large. In this respect, the strength of the compressible spring 26 is relatively large with the second embodiment of the invention. Clearly, the wedge apparatus 10 can be used as a wedge in a wide variety of environments, not only between a door 15 and a floor surface 11.

The components of the door wedge apparatus of the invention can be made from inexpensive and durable metal, plastic and rubber materials.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents falling within the broad scope of the subject matter described above may be resorted to in carrying out the present invention.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved door wedge apparatus that is low in cost, relatively simple in design and operation, and which may advantageously be used by employing a spring which applies a direct upward force on the bottom of a door on which the wedge is used. With the invention, a door wedge apparatus is provided which employs a spring that is interconnected between both the upper and lower wedge members. With the invention, a door wedge apparatus is provided which employs a spring that is interconnected between an upper door-contacting wedge member and a lower floor-contacting wedge member without any intervening wedge members that do not contact either a door or a floor. With the invention, a door wedge apparatus is provided which includes a quantity of high friction material bonded to a top surface of a door-contacting wedge member. With the invention, a door wedge apparatus is provided which includes a quantity of high friction material bonded to a bottom surface of a floor-contacting wedge member.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A portable wedge apparatus adapted to be installed under residential or commercial doors without other preparation or modification thereof, comprising:

a first U-shaped wedge member which includes a first member bottom surface and upwardly oriented first flange portions extending from each outermost longitudinal edge of the bottom surface;

a second U-shaped wedge member which includes a second member top surface and downwardly oriented second flange portions extending from each outermost longitudinal edge of the top surface;

the first and second flange portions extending the entire length of the first and second wedge members respectfully and longitudinally extending beyond the top and bottom surfaces to form rounded edges at both a front and back end of the first and second wedge members;

wherein the first and second wedge members are structurally identical only differing in size;

a pivot pin interconnecting between the front end of said first wedge member and the front end of said second wedge member;

the pivot pin received through holes in the upwardly oriented first flange portions and the downwardly oriented second flange portions, where the first flange portions are nested with the second flange portions so that the pin holes are in alignment; and a compressible coil spring directly connected to said first wedge member bottom surface and said second wedge member top surface at a location distal from said pivot pin, at the back end of the first and second wedge members;

and a high friction material bonded to and covering an entire planar surface of both the bottom and top surfaces of the first and second wedge members for frictionally engaging with one of a floor surface and the door.

2. The apparatus of claim 1 wherein said U-shape second wedge member is nested within said first wedge member when said compressible spring is fully compressed between said first wedge member and said second wedge member.

* * * * *